US007965848B2

(12) United States Patent
Villemoes et al.

(10) Patent No.: US 7,965,848 B2
(45) Date of Patent: Jun. 21, 2011

(54) REDUCED NUMBER OF CHANNELS DECODING

(75) Inventors: Lars Villemoes, Jaerfaella (SE); Kristofer Kjoerling, Solna (SE); Jeroen Breebaart, Eindhoven (NL)

(73) Assignees: Dolby International AB, Amsterdam (NL); Koninklijke Philips Electronics N.V., Eindhoven (NL)

( * ) Notice: Subject to any disclaimer, the term of this patent is extended or adjusted under 35 U.S.C. 154(b) by 1167 days.

(21) Appl. No.: 11/464,149

(22) Filed: Aug. 11, 2006

(65) Prior Publication Data

US 2007/0233293 A1 Oct. 4, 2007

Related U.S. Application Data

(60) Provisional application No. 60/788,911, filed on Apr. 3, 2006.

(30) Foreign Application Priority Data

Mar. 29, 2006 (SE) ..... 0600713

(51) Int. Cl.
*H04R 5/00* (2006.01)

(52) U.S. Cl. ..... 381/22; 381/23; 704/200.1; 704/500; 704/501; 704/200; 704/504; 704/E19.005

(58) Field of Classification Search ..... 381/19–23; 700/94; 704/20, 200.1, 500–501, 200, 201, 704/504, E19.005

See application file for complete search history.

(56) References Cited

U.S. PATENT DOCUMENTS

| | | | | |
|---|---|---|---|---|
| 7,394,903 | B2 * | 7/2008 | Herre et al. | 381/23 |
| 7,765,104 | B2 * | 7/2010 | Pang et al. | 704/500 |
| 2002/0067834 | A1 | 6/2002 | Shirayanagi | |
| 2005/0195981 | A1 | 9/2005 | Faller et al. | |
| 2009/0129601 | A1 * | 5/2009 | Ojala et al. | 381/1 |

FOREIGN PATENT DOCUMENTS

| | | | |
|---|---|---|---|
| CA | 2148447 | C | 5/1994 |
| EP | 1376538 | | 1/2004 |
| TW | 200404222 | | 3/2004 |
| TW | 200405673 | | 4/2004 |
| WO | WO 2004/019656 | A2 | 3/2004 |
| WO | 2005/101370 | | 10/2005 |

OTHER PUBLICATIONS

English Translation of parallel Taiwan Patent Application No. 095141956, Apr. 2009, (4 pages).

(Continued)

*Primary Examiner* — Devona E Faulk
*Assistant Examiner* — Disler Paul
(74) *Attorney, Agent, or Firm* — Michael A. Glenn; Glenn Patent Group

(57) ABSTRACT

An intermediate channel representation of a multi-channel signal can be reconstructed highly efficient and with high fidelity, when upmix parameters for upmixing a transmitted downmix signal to the intermediate channel representation are derived that allow for an upmix using the same upmixing algorithms as within the multi-channel reconstruction. This can be achieved when a parameter re-calculator is used to derive the upmix parameters that takes into account also parameters having information on channels that are not included in the intermediate channel representation.

20 Claims, 6 Drawing Sheets

OTHER PUBLICATIONS

Breebaart, J. et al., "MPEG Spatial Audio Coding / MPEG Surround: Overview and Current Status", Audio Engineering Society Convention Paper, Presented at the 119th Convention, Oct. 7-10, 2005, New York, NY, pp. 1-17, XP-002379094.

Faller, "Coding of Spatial Audio Compatible with Different Playback Formats", Audio Engineering Society Convention Paper, Presented at the 117th Convention, Oct. 28-31, 2004, San Francisco, CA, XP-002364728, pp. 1-12.

English Translation of the Russian Decision to Grant on parallel application No. 2008142742/09(055608), said Decision mailed on Jun. 16, 2010, 10 pages.

* cited by examiner

REDUCED NUMBER OF CHANNELS DECODING

CROSS-REFERENCE TO RELATED APPLICATIONS

This application claims priority to U.S. patent application Ser. No. 60/788,911 filed Apr. 3, 2006, and Sweden patent application number 0600713-2, filed Mar. 29, 2006, which are incorporated herein in their entirety by these references made thereto.

FIELD OF THE INVENTION

The present invention relates to decoding of audio signals and in particular to decoding of a parametric multi-channel downmix of an original multi-channel signal into a number of channels smaller than the number of channels of the original multi-channel signal.

BACKGROUND OF THE INVENTION AND PRIOR ART

Recent development in audio coding has made available the ability to recreate a multi-channel representation of an audio signal based on a stereo (or mono) signal and corresponding control data. These methods differ substantially from older matrix based solutions such as Dolby Prologic, since additional control data is transmitted to control the re-creation, also referred to as upmix, of the surround channels based on the transmitted mono or stereo channels.

Hence, such a parametric multi-channel audio decoder, e.g. MPEG Surround, reconstructs N channels based on M transmitted channels, where N>M, and the additional control data. The additional control data represents a significant lower data rate than transmitting all N channels, making the coding very efficient while at the same time ensuring compatibility with both M channel devices and N channel devices.

These parametric surround coding methods usually comprise a parameterization of the surround signal based on IID (Inter channel Intensity Difference) and ICC (Inter Channel Coherence). These parameters describe power ratios and correlation between channel pairs in the upmix process. Further parameters also used in prior art comprise prediction parameters used to predict intermediate or output channels during the upmix procedure.

Two famous examples of such multi-channel coding are BCC coding and MPEG surround. In BCC encoding, a number of audio input channels are converted to a spectral representation using a DFT (Discrete Fourier Transform) based transform with overlapping windows. The resulting uniform spectrum is then divided into non-overlapping partitions. Each partition has a bandwidth proportional to the equivalent rectangular bandwidth (ERB). Then, spatial parameters called ICLD (Inter-Channel Level Difference) and ICTD (Inter-Channel Time Difference) are estimated for each partition. The ICLD parameter describes a level difference between two channels and the ICTD parameter describes the time difference (phase shift) between two signals of different channels. The level differences and the time differences are given for each channel with respect to a common reference channel. After the derivation of these parameters, the parameters are quantized and encoded for transmission.

The individual parameters are estimated with respect to one single reference channel in BCC-coding. In other parametric surround coding systems, e.g. in MPEG surround, a tree-structured parameterization is used. This means, that the parameters are no longer estimated with respect to one single common reference channel but to different reference channels that may even be a combination of channels of the original multi-channel signal. For example, having a 5.1 channel signal, parameters may be estimated between a combination of the front channels and between a combination of the back channels.

Of course, backward compatibility to already established audio-standards is highly desirable also for the parametric coding schemes. For example, having a mono-downmix signal it is desirable to also provide a possibility to create a stereo-playback signal with high fidelity. This means that a monophonic downmix signal has to be upmixed into a stereo signal, making use of the additionally transmitted parameters in the best possible way.

One common problem in multi-channel coding is energy preservation in the upmix, as the human perception of the spatial position of a sound-source is dominated by the loudness of the signal, i.e. by the energy contained within the signal. Therefore, utmost care must be taken in the reproduction of the signal to attribute the right loudness to each reconstructed channel such as to avoid the introduction of artifacts strongly decreasing the perceptional quality of the reconstructed signal. As during the downmix amplitudes of signals are commonly summed up, the possibility of interference arises, being described by the correlation or coherence parameter.

When it comes to the reconstruction of a reduced number of channels (a number of channels smaller than the original number of channels of the multi-channel signal), schemes like BCC are simple to handle, since every parameter is transmitted with respect to the same single reference channel. Therefore, having knowledge on the reference channel, the most relevant level information (absolute energy measure) can easily be derived for every channel needed for the upmix. Thus, reduced number of channels can be reconstructed without the need to reconstruct the full multi-channel signal first. Thus, the energy computations for the energies of the multi-channel signal is easier in BCC by using single variables rather than products of variables, but this is only a first step. When it comes to deriving energies and correlations of a reduced number of channels which should come as close as possible to partial downmixes of the original multichannel signals, the level of difficulty in MPEG Surround and BCC is comparable.

In contrast thereto, a tree-based structure as MPEG surround uses a parameterization in which the relevant information for each individual channel is not contained in a single parameter. Therefore, in prior art, reconstructing reduced numbers of channels requires the reconstruction of the multi channel signal followed by a downmix into the reduced numbers of channels to not violate the energy preservation requirement. This has the obvious disadvantage of extremely high computational complexity.

SUMMARY OF THE INVENTION

It is the object of the present invention to provide a concept for obtaining a reduced number of channels from a parametric multichannel signal more efficiently.

In accordance with a first aspect of the present invention, this object is achieved by a parameter calculator for deriving upmix parameters for upmixing a downmix signal into an intermediate channel representation of a multi-channel signal having more channels than the downmix signal and less channels than the multi-channel signal, the downmix signal having associated thereto multi-channel parameters describing spatial properties of the multi-channel signal, wherein the multi-channel signal includes channels not included in the intermediate channel representation and wherein the multi-channel parameters include information on the channels not included in the intermediate channel representation, the parameter calculator comprising: a parameter recalculator for deriving the upmix parameters from the multi-channel parameters using the parameters having information on channels not included in the intermediate channel representation.

In accordance with a second aspect of the present invention, this object is achieved by a channel reconstructor having a parameter reconstructor, comprising: a parameter calculator for deriving upmix parameters for upmixing a downmix signal into an intermediate channel representation of a multi-channel signal having more channels than the downmix signal and less channels than the multi-channel signal, the downmix signal having associated thereto multi-channel parameters describing spatial properties of the multi-channel signal, wherein the multi-channel signal includes channels not included in the intermediate channel representation and wherein the multi-channel parameters include information on the channels not included in the intermediate channel representation, the parameter calculator comprising: a parameter recalculator for deriving the upmix parameters from the multi-channel parameters using the parameters having information on channels not included in the intermediate channel representation; and an upmixer for deriving the intermediate channel representation using the upmix parameters and the downmix signal.

In accordance with a third aspect of the present invention, this object is achieved by a method for generating upmix parameters for upmixing a downmix signal into an intermediate channel representation of a multi-channel signal having more channels than the downmix signal and less channels than the multi-channel signal, the downmix signal having associated thereto multi-channel parameters describing spatial properties of the multi-channel signal, wherein the multi-channel signal includes channels not included in the intermediate channel representation and wherein the multi-channel parameters include information on the channels not included in the intermediate channel representation, the method comprising: deriving the upmix parameters from the multi-channel parameters using the parameters having information on channels not included in the intermediate channel representation.

In accordance with a fourth aspect of the present invention, this object is achieved by an audio receiver or audio player, the receiver or audio player having a parameter calculator for deriving upmix parameters for upmixing a downmix signal into an intermediate channel representation of a multi-channel signal having more channels than the downmix signal and less channels than the multi-channel signal, the downmix signal having associated thereto multi-channel parameters describing spatial properties of the multi-channel signal, wherein the multi-channel signal includes channels not included in the intermediate channel representation and wherein the multi-channel parameters include information on the channels not included in the intermediate channel representation, the parameter calculator comprising: a parameter recalculator for deriving the upmix parameters from the multi-channel parameters using the parameters having information on channels not included in the intermediate channel representation.

In accordance with a fifth aspect of the present invention, this object is achieved by a method of receiving or audio playing, the method having a method for generating upmix parameters for upmixing a downmix signal into an intermediate channel representation of a multi-channel signal having more channels than the downmix signal and less channels than the multi-channel signal, the downmix signal having associated thereto multi-channel parameters describing spatial properties of the multi-channel signal, wherein the multi-channel signal includes channels not included in the intermediate channel representation and wherein the multi-channel parameters include information on the channels not included in the intermediate channel representation, the method comprising: deriving the upmix parameters from the multi-channel parameters using the parameters having information on channels not included in the intermediate channel representation.

The present invention is based on the finding that an intermediate channel representation of a multi-channel signal can be reconstructed highly efficient and with high fidelity, when upmix parameters for upmixing a transmitted downmix signal to the intermediate channel representation are derived that allow for upmix using the same upmixing algorithms as within the multi-channel reconstruction. This can be achieved when a parameter re-calculator is used to derive the upmix parameters taking also into account parameters having information on channels not included in the intermediate channel representation.

In one embodiment of the present invention, a decoder is capable of reconstructing a stereo output signal from a parametric downmix of a 5-channel multi-channel signal, the parametric downmix comprising a monophonic downmix signal and associated multi-channel parameters. According to the invention, the spatial parameters are combined to derive upmix parameters for the upmix of a stereo signal, wherein the combination also takes into account multi-channel parameters not associated to the left-front or the right-front channel. Hence, absolute powers for the upmixed stereo-channels can be derived and a coherence measure between the left and the right channel can be derived allowing for a high fidelity stereo reconstruction of the multi-channel signal. Moreover, an ICC parameter and a CLD parameter are derived allowing for an upmixing using already existing algorithms and implementations. Using parameters of channels not associated to the reconstructed stereo-channels allows for the preservation of the energy within the signal with higher accuracy. This is of most importance, as uncontrolled loudness variations are disturbing the quality of the playback signal most.

Generally, the application of the inventive concept allows a reconstruction of a stereo upmix from a mono-downmix of a multi-channel signal without the need of an intermediate full reconstruction of the multi-channel signal, as in prior art methods. Evidently, the computational complexity on the decoder side can thus be decreased significantly. Using also multi-channel parameters associated to channels not included in the upmix (i.e. the left front and the right front channel) allows for a reconstruction that does not introduce any additional artifacts or loudness-variations but preserves the energy of the signal perfectly instead. To be more specific, the ratio of the energy between the left and the right reconstructed channel is calculated from numerous available multi-channel parameters, taking also into account multi-channel parameters not associated to the left front and the right front channel. Evidently, the loudness ratio between the left and the right reconstructed (upmixed) channel is dominant with respect to the listening quality of the reconstructed stereo signal. Without using the inventive concept a reconstruction of channels having the precisely correct energy ratio is not possible in tree-based structures discussed within this document.

Therefore, implementing the inventive concept allows for a high-quality stereo-reproduction of a downmix of a multi-channel signal based on multi-channel parameters, which are not derived for a precise reproduction of a stereo signal.

It should be noted, that the inventive concept may also be used when the number of reproduced channels is other than two, for example when a center-channel shall also be reconstructed with high fidelity, as it is the case in some playback environments.

A more detailed review of the prior art, multi-channel encoding schemes (particularly of tree-based structures) will be given within the following to outline the high benefit of the inventive concept.

BRIEF DESCRIPTION OF THE DRAWINGS

Preferred embodiments of the present invention are subsequently described by referring to the enclosed drawings, wherein.

DETAILED DESCRIPTION OF PREFERRED EMBODIMENTS

The inventive concept will in the following be described mainly with respect to MPEG coding, but is as well applicable to other schemes based on parametric coding of multi-channel signals. That is the embodiments described below are merely illustrative for the principles of the present invention for reduced number of channels decoding for tree-structured multi-channel systems. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

As mentioned above, in some parametric surround coding systems, e.g. MPEG Surround, a tree-structured parameterization is used. Such a parameterization is sketched in FIG. 1 and FIG. 2.

Figure 1:
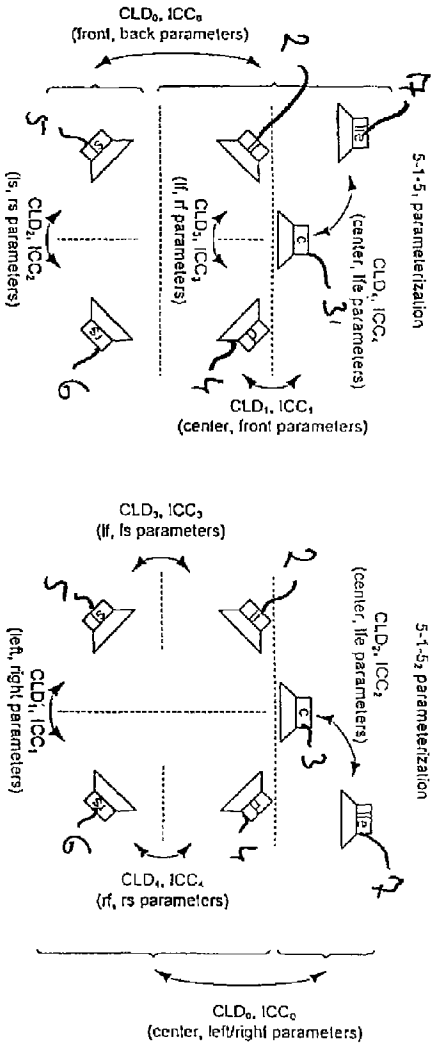
FIG. 1 shows examples for tree-based parameterizations.

FIG. 1 shows two ways of parameterizing a standard 5.1 channel audio scenario, having a left front channel 2, a center channel 3, a right front channel 4, a left surround channel 5 and a right surround channel 6. Optionally, a low-frequency enhancement channel 7 (LFE) may also be present.

Generally, the individual channels or channel pairs are characterized with respect to each other by multi-channel parameters, such as for example a correlation parameter ICC and a level parameter CLD. Possible parameterizations will be shortly explained in the following paragraph, the resulting tree-structured decoding schemes are then illustrated in FIG. 2.

In the example shown in the left side of FIG. 1 (5-1-5$_1$ parameterization), the multi-channel signal is characterized by CLD and ICC parameters describing the relation between the left surround channel 5 and the right surround channel 6, the left front channel 2 and the right front channel 4 and between the center channel 3 and the low-frequency enhancement channel 7. However, as the whole configuration shall be downmixed into one single mono channel, for a full description of the set of channels, additional parameters are required. Therefore, additional parameters ($CLD_1$, $ICC_1$) are used, relating a combination of the LFE-speaker 7 and the center speaker 3 to a combination of the left front channel 2 and the right front channel 4. Furthermore, one additional set of parameters ($CLD_0$, $ICC_0$) is required, those parameters describing a relation between the combined surround channels 5 and 6 to the rest of the channels of the multi-channel signal.

In the parameterization on the right side (5-1-5$_2$ parameterization) parameters are used, relating the left front channel 2 and the left surround channel 5, the right front channel 4 and the right surround channel 6 and the center channel 3 and the low-frequency enhancement channel 7. Additional parameters ($CLD_1$ and $ICC_1$) describe a combination of the left channels 2 and 5 with respect to a combination of the right channels 4 and 6. A further set of parameters ($CLD_0$ and $ICC_0$) describes the relation of a combination of the center channel 3 and the LFE-channel 7 with respect to a combination of the remaining channels.

Figure 2:
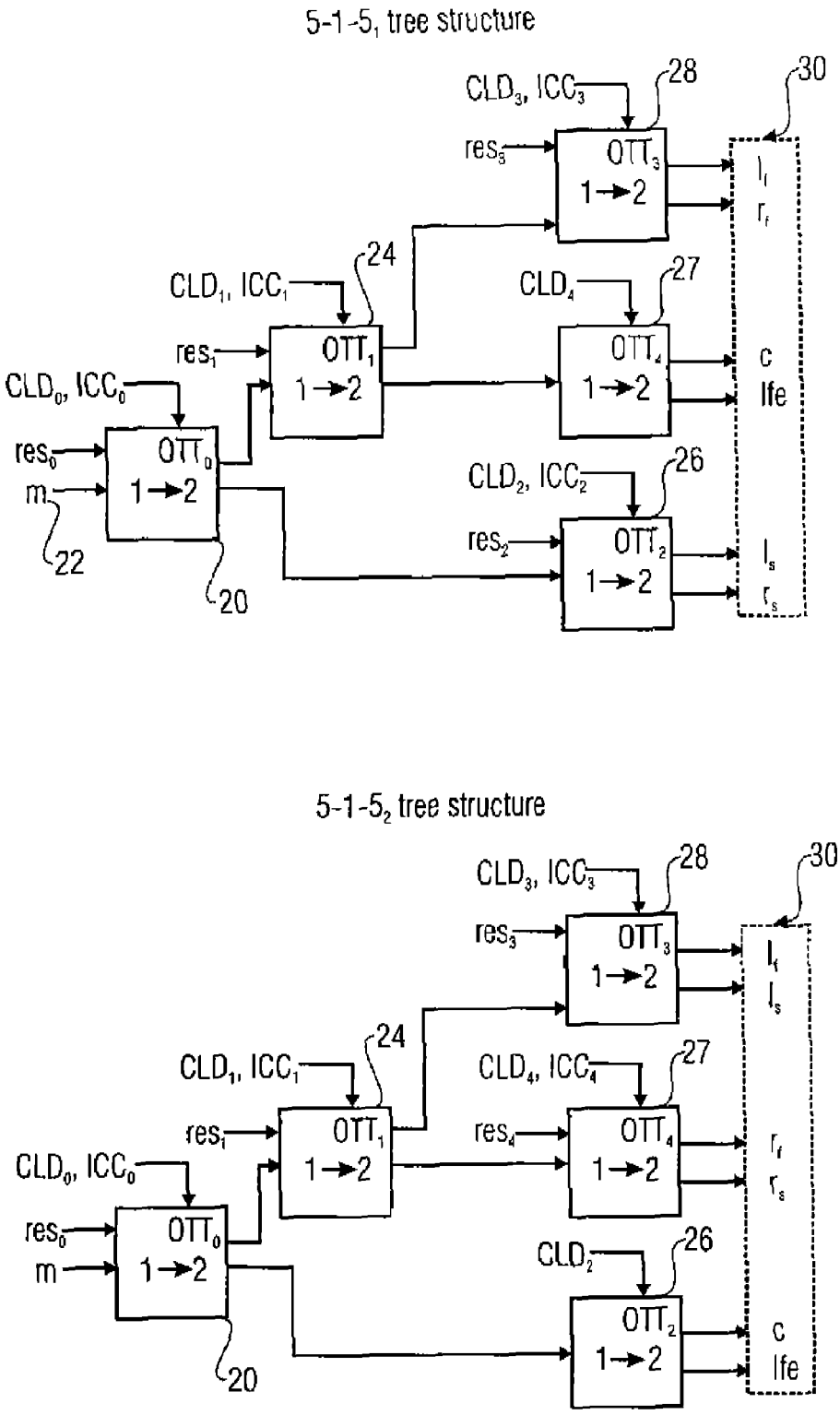
FIG. 2 shows examples for tree-structured decoding schemes.

FIG. 2 illustrates the coding concepts underlying the different parameterizations of FIG. 1. At the decoder side so called OTT (One To Two) modules are used in a tree-like structure. Every OTT module upmixes a mono-signal into two output signals. When decoding, the parameters for the OTT boxes have to be applied in the reverse order as in encoding. Therefore, in the 5-1-5$_1$ tree structure, OTT module 20, receiving the downmix signal 22 (M) is operative to use parameters $CLD_0$ and $ICC_0$ to derive two channels, one being a combination of the left surround channel 5 and the right surround channel 6 and the other channel being still a combination of the remaining channels of the multi-channel signal.

Accordingly, OTT module 24 derives, using $CLD_1$ and $ICC_1$, first channel being a combined channel of the center channel 3 and the low-frequency channel 7 and a second channel being a combination of the left front channel 2 and the right front channel 4. In the same way, OTT module 26 derives the left surround channel 5 and the right surround channel 6, using $CLD_2$ and $ICC_2$. OTT module 27 derives the center channel 3 and the low-frequency channel 7, using $CLD_4$ and OTT module 28 derives the left front channel 2 and the right front channel 4, using $CLD_3$ and $ICC_3$. Finally, a reconstruction of the full set of channels 30 is derived from a single monophonic downmix channel 22. For the 5-1-5$_2$ tree structure, the general layout of the OTT module is equivalent to the 5-1-5$_1$ tree structure. However, the single OTT modules derive different channel combinations, the channel combinations corresponding to the parameterization outlined in FIG. 1 for the 5-1-5$_2$-case.

It becomes evident from FIGS. 1 and 2, that the tree-structure of the different parameterizations is only a visualization for the parameterization used. It is furthermore important to note that the individual parameters are parameters describing a relation between different channels in contrast to, for example, the BCC-coding scheme, wherein similar parameters are derived with respect to one single reference channel.

Therefore, in the parameterizations shown, individual channels cannot be simply derived using the parameters associated to the OTT-boxes in the visualization, but some or all of the remaining parameters have to be taken into account additionally.

Figure 3:
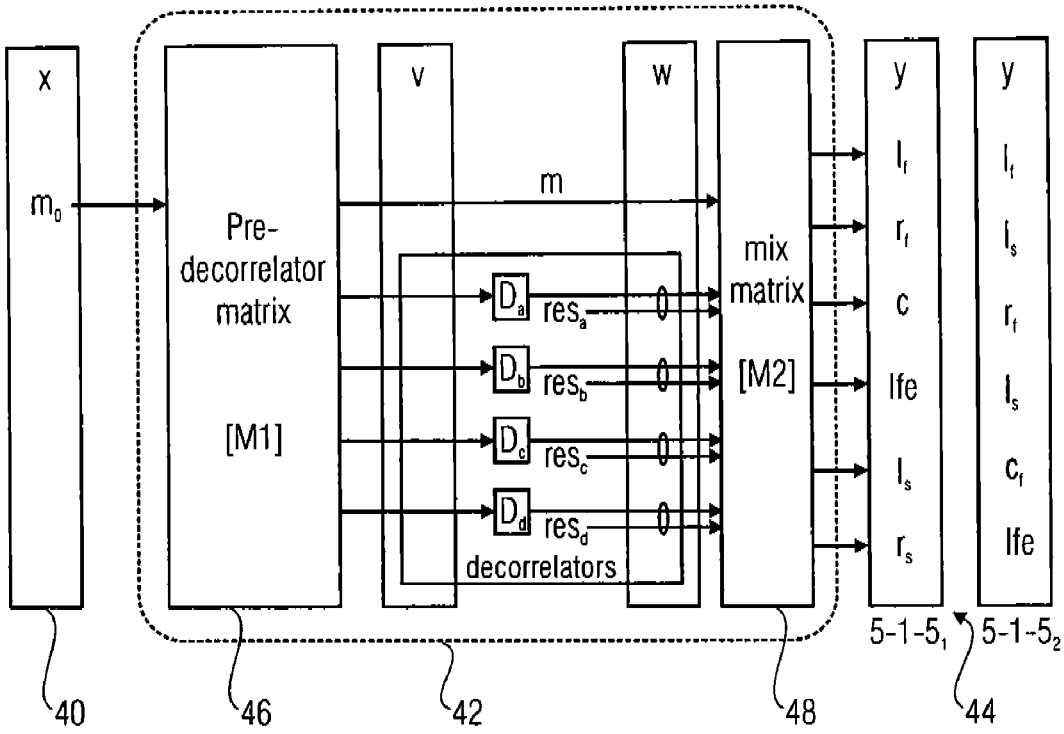
FIG. 3 shows an example of a prior-art multi-channel encoder.

The tree-structure of the parameterization is only a visualization for actual signal flow or processing shown in FIG. 3, illustrating the upmix from a transmitted low number of channels is achieved by matrix multiplication. FIG. 3 shows decoding based on a received downmixed channel 40. The downmixed channel 40 is input into an upmix block 42 deriving the reconstructed multi-channel signal 44, wherein the channel composition differs between the parameterizations used. The matrix elements of the matrix used by the reconstruction block 42 are, however, directly derived from the tree-structure. The reconstruction block 42 may, for illustrative purposes only, be further decomposed into a pre-decorrelator matrix 46, deriving additional decorrelated signals from the transmitted channel 40. These are then input into a mix matrix 48 deriving multi-channel signals 44 by mixing the individual input channels.

Figure 4:
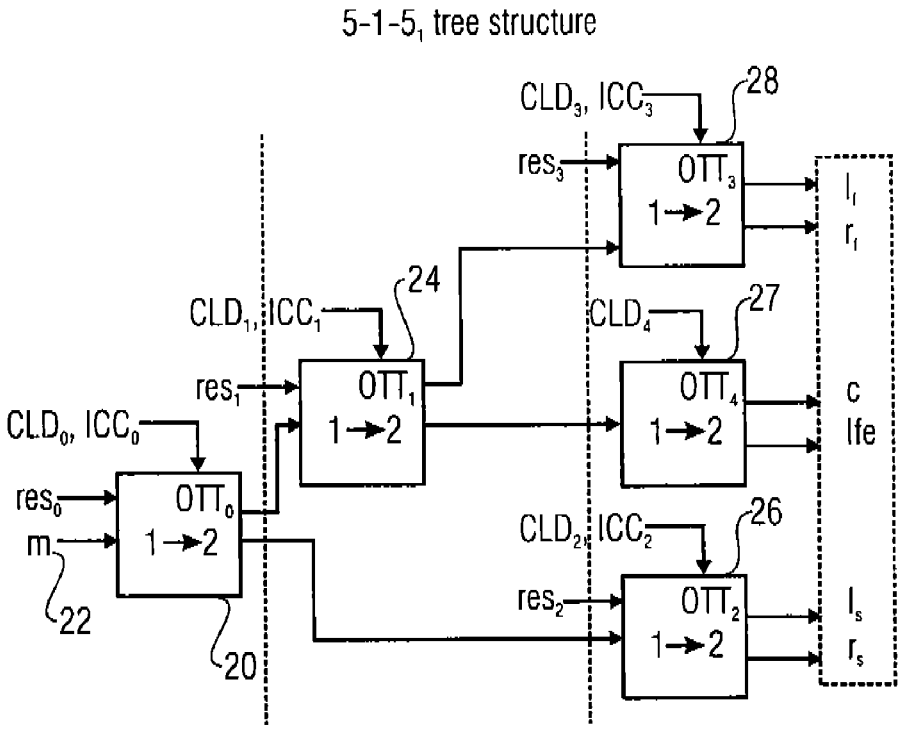
FIG. 4 shows examples of prior-art decoders.
Figure 4:
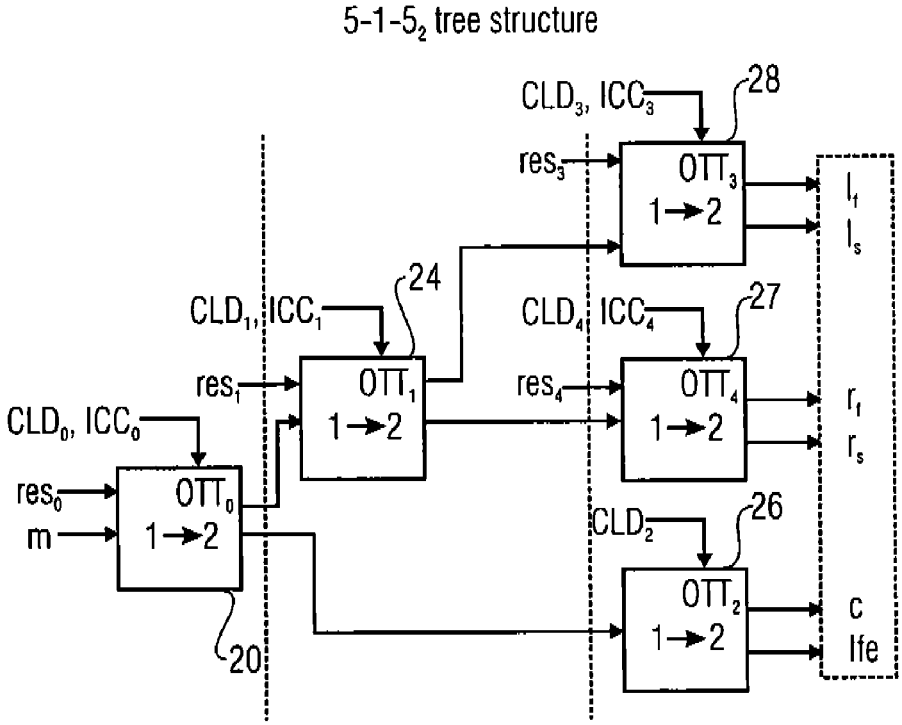
Figure 5:
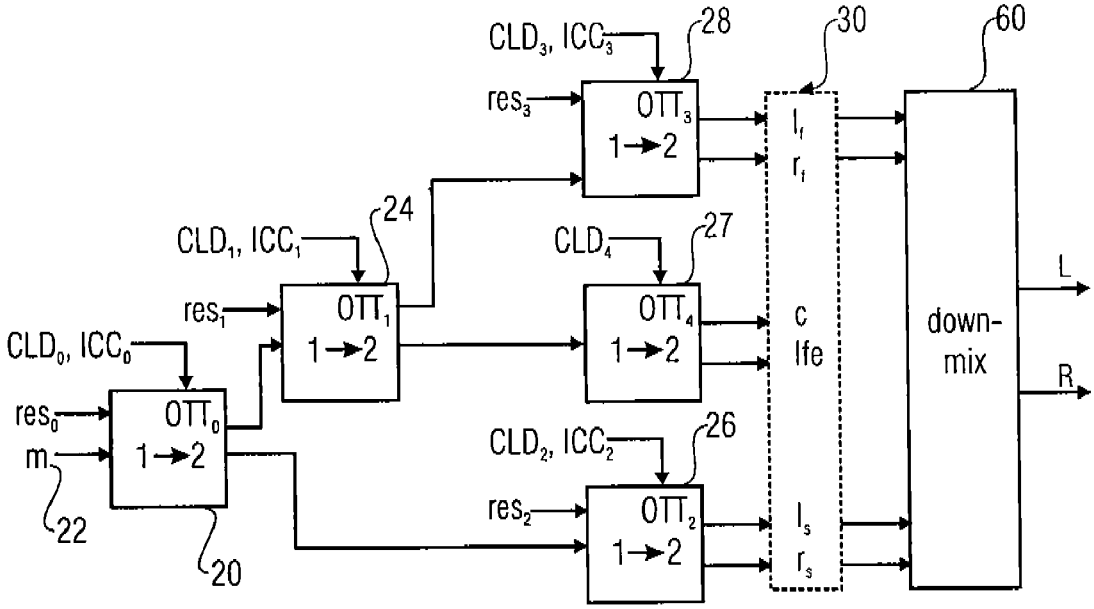
FIG. 5 shows an example for prior-art stereo reconstruction of a downmix multi-channel signal.

As shown in FIG. 4, a straightforward approach to reduce the number of reconstructed channels would be to simply "prune" the tree of the one to two boxes. FIG. 4 illustrates a possible pruning of the trees by dashed lines, the pruning omitting OTT modules at the right hand side of the tree during reconstruction, thus reducing the number of output channels. However, using prior art parameterizations of shown in FIGS. 1 and 2, introduced because they offer low-bit rate coding at highest possible quality, simple pruning is not possible to obtain a stereo output representing a left side downmix and a right side downmix of the original multichannel signal properly. FIG. 5 shows a prior art approach of creating a stereo output from the signals described above, using the obvious approach of first reconstructing the multi-channel signal completely before subsequently downmixing the signal into the stereo representation using an additional downmixer 60. This has evidently several disadvantages, such as high complexity and inferior sound quality.

A solution to the afore-mentioned problem of obtaining stereo output from a mono downmix and parametric surround parameters in a parameterization that does not naturally support "pruning" down to a stereo output will in the following be derived for the general case. This is followed by two specific embodiments showing the use of the inventive concept in the parameterizations described above. Thus, solutions are provided to the problem of obtaining stereo output from a mono downmix and parametric surround parameters in a parameterization that does not support "pruning" down to a stereo output.

The general approach of the parameter recalculation will be outlined below. In particular, it applies to the case of computing stereo output parameters from an arbitrary number of multi-channel audio channels N. It is furthermore assumed that the audio signal is described by a subband representation, derived using a filter bank that could be real valued or complex modulated.

Let all signals considered be finite vectors of subband samples corresponding to a time frequency tile defined by the spatial parameters and let the subband samples of a reconstructed multi-channel audio signal y be formed from subband samples of audio channels $m_1, m_2, \ldots, m_M$ and decorrelated subband samples of audio channels $d_1, d_2, \ldots, d_D$ according to a matrix upmix operation $$y = Rx, \text{ where}$$

$$x = \begin{bmatrix} m_1 \\ m_2 \\ \vdots \\ m_M \\ d_1 \\ d_2 \\ \vdots \\ d_D \end{bmatrix}.$$

All signals are regarded as row vectors. The matrix R is of size N×(M+D) and represents the combined effect of the matrices M1 and M2 of FIG. 3 and as such the upmix block 42. A general method for achieving suitable power and correlation parameters of a downmixed version to $N_D$ channels of the original multichannel audio signal subband samples is to form the covariance matrix of the virtual downmix defined by a $N_D \times N$ downmix matrix D, $$y_D = Dy.$$

This covariance matrix can be computed by multiplication with complex conjugate transposed to be $$y_D y^*_D = Dyy^*D^* = DRxx^*R^*D^*,$$

where the inner covariance matrix xx* is often known from the properties of decorrelators and the transmitted parameters.

An important special case where this holds true is for M=1, and frequently this inner covariance matrix is then actually equal to the identity matrix of size M+D. As a consequence, for a stereo output where $N_D=2$, the CLD and ICC parameters can be read from $$y_D y_D^* = \begin{bmatrix} L_0 & \langle l_0, r_0 \rangle \\ \langle r_0, l_0 \rangle & R_0 \end{bmatrix}$$

in the sense that $$CLD = 10\log_{10}\left(\frac{L_0}{R_0}\right),$$

and $$ICC = \frac{\mathrm{Re}\langle l_0, r_0 \rangle}{\sqrt{L_0 R_0}}.$$

Note that here and in the following, the following notation is applied. For complex vectors x,y, the complex inner product and squared norm is defined by $$\left\{ \begin{aligned} &\langle x, y \rangle = \sum_n x(n) y^*(n), \\ &X = \|x\|^2 = \langle x, y \rangle = \sum_n |x(n)|^2, \\ &Y = \|y\|^2 = \langle y, y \rangle = \sum_n |y(n)|^2, \end{aligned} \right\}$$

where the star denotes complex conjugation.

Subsequently, two embodiments of the present invention shall be derived for the different parameterizations (5-1-5$_1$ and 5-1-5$_2$) shown in FIGS. 1 and 2. In the embodiments of the present invention it is taught that in order to output stereo signals based on a mono downmix and corresponding MPEG surround parameters (multi-channel parameters), upmix-parameters need to be recalculated to a single set of CLD and ICC parameters that can be used for a direct upmix of a stereo signal from the mono signal.

It is furthermore assumed that the processing of the individual audio channels is done frame wise, i.e. in discrete time portions. Thus, when talking about powers or energies contained within one channel, the term "power" or "energy" is to be understood as the energy or power contained within one frame of one specific channel.

Generally, parameters as for example CLD and ICC are also valid for one single frame. Having a frame with k sample values $a_i$, the energy E within the frame can for example be represented by the squared sum of the subband sample values within the frame:

$$E = \sum_{i=1}^{k} a_i a_i^*$$

Channel level differences (CLD) transmitted and used for the calculation of upmix parameters for upmixing the downmix signal M into an intermediate channel representation (stereo) of the multi-channel signal are defined as follows:

$$CLD = 10\log_{10}\left(\frac{L_0}{R_0}\right),$$

wherein $L_0$ and $R_0$ denote the power of the signals in question within the frame for which the parameter CLD shall be derived.

Therefore, for the 5-1-5$_1$ case, the four CLD parameters $CLD_X$, X=0,1,2,3, can be used to obtain channel powers normalized by the power of the mono downmix channel m.

$$L_f=(c_{10}c_{11}c_{13})^2,$$

$$R_f=(c_{10}c_{11}c_{23})^2,$$

$$C=(c_{10}c_{21})^2,$$

$$L_s=(c_{20}c_{12})^2,$$

$$R_s=(c_{20}c_{22})^2.$$

The channel gains are defined by $$c_{1X} = \sqrt{\frac{10^{CLD_X/10}}{1+10^{CLD_X/10}}}$$

and $$c_{2X} = \sqrt{\frac{1}{1+10^{CLD_X/10}}}.$$

The final goal is to derive optimal stereo channels $l_0$ and $r_0$ in the sense that appropriate estimates of the normalized powers and correlation of the stereo channels (intermediate channel representation) formed by $$l_0=l+qc, \text{ with } l=G(l_f+l_s), \text{ such that } L=L_f+L_s,$$

$$r_0=r+qc, \text{ with } r=G(r_f+r_s), \text{ such that } R=R_f+R_s.$$

are found, wherein the center downmix weight is $q=1/\sqrt{2}$. Computing powers from this assumption gives the result $$L_0=L+q^2C+2Re\langle l,qc\rangle,$$

$$R_0=R+q^2C+2Re\langle r;qc\rangle.$$

It turns out to be most advantageous to assume that both the combined left channel l and the combined right channel rare uncorrelated with the center channel c, rather than attempting to incorporate the correlation information carried by the parameters $ICC_X^{l,m}$, X=0,1. The normalized powers of the stereo output channels are therefore estimated by $$L_0 = L_f + L_s + \frac{C}{2},$$

$$R_0 = R_f + R_s + \frac{C}{2}.$$

Having derived the powers of the output channels, the desired CLD parameter can easily be computed using the definition of the CLD parameter given above.

According to the inventive concept, an ICC parameter is derived to allow a stereo upmix. The correlation between the two output channels is defined by the following expression:

$$p=Re\langle l_0,r_0\rangle=q^2C+Re\langle l,r\rangle+qRe\langle c,l+r\rangle.$$

An attractive set of simplifying assumptions is here again that the combined left channel l and the combined right channel r are uncorrelated with the center channel c, and moreover that the surround channels are uncorrelated with the front channels. These assumptions can be expressed by $$Re\langle c,l+r\rangle=0,$$

$$Re\langle l,r\rangle=Re\langle l_f,r_f\rangle+Re\langle l_s,r_s\rangle.$$

The resulting estimate for p depends on the two ICC parameters $ICC_X$, X=2,3, which describe normalized left/right correlations $$p = \frac{C}{2} + ICC_2\sqrt{L_sR_s} + ICC_3\sqrt{L_fR_f},$$

which can be written out as $$p = \frac{C}{2} + ICC_2c_{20}^2c_{12}c_{22} + ICC_3(c_{10}c_{11})^2c_{13}c_{23}.$$

Thus, the final correlation value depends on numerous parameters of the multi-channel parameterization, allowing for the high fidelity reconstruction of the signal. The ICC parameter is finally derived using the following formula:

$$ICC = \max\left\{-.99, \min\left\{1, \frac{p}{\sqrt{L_0R_0}}\right\}\right\}$$

According to the inventive concept, the power distribution between the reconstructed channels is reconstructed with high accuracy. However, a global power scaling applied to both channels may be additionally necessary, to assure for overall energy preservation. As the relative energy distribution between the channels is vital for the spatial perception of the reconstructed signal, global scaling may deteriorate the perceptual quality of the reconstructed signal. It is to be emphasized that the global scaling is only global inside a parameter defined time-frequency tile. This means that wrong scalings will affect the signal locally at the scale of parameter tiles. In other words both frequency and time depending gains will be applied which lead to both spectral colorization and time modulation artifacts. A gain adjustment factor for global scaling is necessary to assure that the stereo upmix process is preserving the power of the mono downmix channel m.

However, this factor is defined by $g=\sqrt{L_0+R_0}$, which amounts to g=1 for the 5-1-5$_1$ configuration, since $L_0+R_0=L_f+R_f+C+L_s+R_s=1$.

As a further embodiment, the application of the inventive concept to the 5-1-5$_2$ tree-structure will be outlined within the following paragraphs. For the creation of a high-fidelity stereo signal, the two first CLD and ICC parameter sets corresponding to the top branches of the tree are relevant.

The two CLD parameters $CLD_X$ for X=0,1, are used first to obtain normalized channel powers of the combined left and right channels and the center channel $$L=(c_{10}c_{11})^2,$$

$$R=(c_{10}c_{21})^2,$$

$$C=c_{20}^2,$$

where the channel gains are defined by $$c_{1X}=\sqrt{\frac{10^{CLD_X/10}}{1+10^{CLD_X/10}}}$$

and $$c_{2X}=\sqrt{\frac{1}{1+10^{CLD_X/10}}}$$

The goal is to derive the powers and correlation of the downmix channels $$l_0=l+qc,$$

$$r_0=r+qc,$$

where the center downmix weight is $q=1/\sqrt{2}$. Computing powers from this assumption gives the result $$L_0=L+q^2C+2Re\langle l,qc\rangle,$$

$$R_0=R+q^2C+2Re\langle r,qc\rangle.$$

An advantageous assumption is here that both the ICC between the channels l and c and between channels r and cis the same as the given $ICC_0$ between the channels l+r and c. This assumption leads to the estimates $$Re\langle l,c\rangle=ICC_0\sqrt{LC},$$

$$Re\langle r,c\rangle=ICC_0\sqrt{RC},$$

such that the estimates of the normalized powers become $$L_0=L+\frac{C}{2}+\sqrt{2}\,ICC_0\sqrt{LC},$$

$$R_0=R+\frac{C}{2}+\sqrt{2}\,ICC_0\sqrt{RC}.$$

As in the preceding embodiment, having the power values $L_0$ and $R_0$, the desired CLD parameter can be derived:

$$CLD=10\log_{10}\left(\frac{L_0}{R_0}\right).$$

Deriving the correlation and finally the ICC parameter starts from the general definition of the correlation value:

$$p=Re\langle l_0,r_0\rangle=q^2C+Re\langle l,r\rangle+qRe\langle c,l+r\rangle.$$

All the necessary information is available from the parameters of the 5-1-5$_2$ tree structure since $$Re\langle c,l+r\rangle=ICC_0\sqrt{C}\|l+r\|,$$

$$\|l+r\|^2=L+R+2Re\langle l,r\rangle,$$

$$Re\langle l,r\rangle=ICC_1\sqrt{LR}.$$

The final results can be written out as $$L_0=L+\frac{C}{2}+\sqrt{2}\,ICC_0c_{10}c_{11}c_{20},$$

$$R_0=R+\frac{C}{2}+\sqrt{2}\,ICC_0c_{10}c_{21}c_{20},$$

$$p=\frac{C}{2}+c_{10}\left(ICC_1c_{10}c_{11}c_{21}+\frac{1}{\sqrt{2}}ICC_0c_{20}\sqrt{1+ICC_1c_{11}c_{21}}\right).$$

The required gain adjustment factor g is defined by:

$$g=\sqrt{L_0+R_0}$$

It may be noted, that the generated CLD and ICC parameters may further be quantized, to enable the use of lookup tables in the decoder for upmix matrix creation rather than performing the complex calculations. This further increases the efficiency of the upmix process.

Generally, upmix is possible using already existing OTT modules. This has the advantage that the inventive concept can be easily implemented in already existing decoding scenarios.

Generally, the upmix matrix can be described as follows:

$$H=\begin{bmatrix}h_{11} & h_{12}\\ h_{21} & h_{22}\end{bmatrix}=g\cdot\begin{bmatrix}c_1\cos(\alpha+\beta) & c_1\sin(\alpha+\beta)\\ c_2\cos(-\alpha+\beta) & c_2\sin(-\alpha+\beta)\end{bmatrix}$$

where $$c_1=\sqrt{\frac{10^{CLD/10}}{1+10^{CLD/10}}}\quad\text{and}\quad c_2=\sqrt{\frac{1}{1+10^{CLD/10}}}$$

and where:

$$\beta=\arctan\left(\tan(\alpha)\frac{c_2-c_1}{c_2+c_1}\right),$$

and $$\alpha=\frac{1}{2}\arccos(ICC).$$

Therefore, having inventively derived the parameters CLD and ICC, stereo upmix of a transmitted downmix can be performed with high fidelity using standard upmix modules.

In a further embodiment of the present invention, an inventive Channel reconstructor comprises a parameter calculator for deriving upmix parameters and an upmixer for deriving an intermediate channel representation using the upmix parameters and a transmitted downmix signal.

Figure 6:
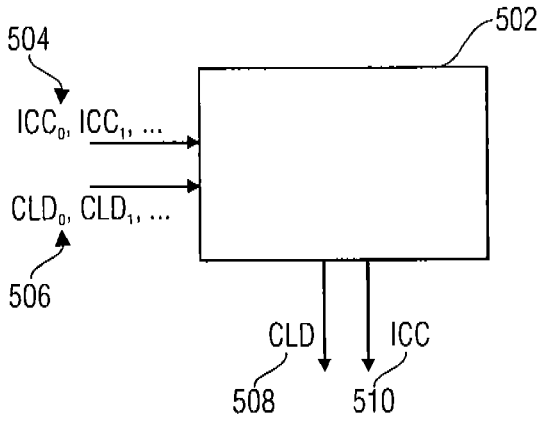
FIG. 6 shows a block diagram of an example of an inventive parameter calculator.

The inventive concept is again outlined in FIG. 6, showing an inventive parameter calculator 502, receiving numerous ICC parameters 504 and numerous CLD parameters 506. According to one embodiment of the present invention, the inventive parameter calculator 502 derives a single CLD parameter 508 and a single ICC parameter 510 for the recreation of a stereo signal, using also multi-channel parameters (ICC and CLD) having information on channels not included or related to channels of the stereo-upmix.

It may be noted, that the inventive concept can easily be adapted to scenarios with an upmix comprising more than two channels. The upmix is in that sense generally defined as an intermediate channel representation of the multi-channel signal, wherein the intermediate channel representation has more channels than the downmix signal and less channels than the multi-channel signal. One common scenario is a configuration in which an additional center channel is reconstructed.

Figure 7:
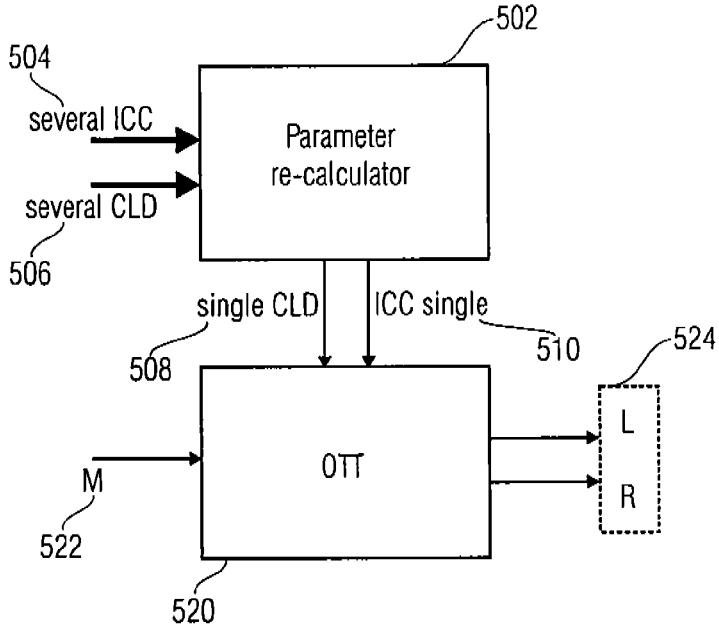
FIG. 7 shows an example for an inventive channel reconstructor.

The application of the inventive concept is again outlined in FIG. 7, showing an inventive parameter calculator 502 and a 1-to-2 box OTT 520. The OTT box 520 receives as input the transmitted mono signal 522, as already detailed in FIG. 6. The inventive parameter calculator 502 receives several ICC values 504 and several CLD values 506 to derive a single CLD parameter 508 and a single ICC parameter 510.

The single CLD and ICC parameters 508 and 510 are input in the OTT module 520 to steer the upmix of the monophonic downmix signal 522. Thus, at the output of the OTT module 520, a stereo signal 524 can be provided as an intermediate channel representation of the multi-channel signal.

Figure 8:
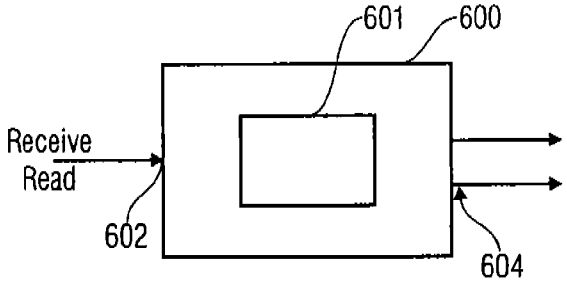
FIG. 8 shows an example for an inventive receiver or audio player.

FIG. 8 shows an inventive receiver or audio player 600, having an inventive audio decoder 601, a bit stream input 602, and an audio output 604.

A bit stream can be input at the input 602 of the inventive receiver/audio player 600. The decoder 601 then decodes the bit stream and the decoded signal is output or played at the output 604 of the inventive receiver/audio player 600.

Although the inventive concept has been outlined mainly with respect to MPEG surround coding, it is of course by no means limited to the application to the specific parametric coding scenario. Because of the high flexibility of the inventive concept, it can be easily applied to other coding schemes as well, such as for example to 7.1 or 7.2 channel configurations or BCC schemes.

Although the embodiments of the present invention relating to MPEG-coding introduce some simplifying assumptions for the generation of the common CLD and ICC parameter, this is not mandatory. It is of course also possible to not introduce those simplifications.

Depending on certain implementation requirements of the inventive methods, the inventive methods can be implemented in hardware or in software. The implementation can be performed using a digital storage medium, in particular a disk, DVD or a CD having electronically readable control signals stored thereon, which cooperate with a programmable computer system such that the inventive methods are performed. Generally, the present invention is, therefore, a computer program product with a program code stored on a machine readable carrier, the program code being operative for performing the inventive methods when the computer program product runs on a computer. In other words, the inventive methods are, therefore, a computer program having a program code for performing at least one of the inventive methods when the computer program runs on a computer.

While the foregoing has been particularly shown and described with reference to particular embodiments thereof, it will be understood by those skilled in the art that various other changes in the form and details may be made without departing from the spirit and scope thereof. It is to be understood that various changes may be made in adapting to different embodiments without departing from the broader concepts disclosed herein and comprehended by the claims that follow.

What is claimed is:

1. Parameter calculator for deriving upmix parameters, the parameter calculator comprising:

a parameter recalculator for deriving the upmix parameters from multi-channel parameters using parameters having information on channels not included in an intermediate channel representation, wherein the parameter recalculator is adapted to use correlation parameters (ICC) having information on a correlation and level parameters (CLD) having energy information for a channel or a combination of channels of the multi-channel signal with respect to another channel or another combination of channels of a multi-channel signal, wherein the parameter calculator is configured to use multi-channel parameters for a multi-channel signal comprising a left front (LF), a left surround (LS), a right front (RF), a right surround (RS) and a center channel (C), and the parameter recalculator is operative to derive upmix parameters for an intermediate channel representation having two channels, the upmix parameters including one CLD parameter and one ICC parameter, wherein the parameter recalculator is operative to derive the CLD parameter having energy information for a left and a right channel of the intermediate channel representation using:

a first CLD parameter ($CLD_0$) having energy information for a combination of the LF and LR channel and a combination of the remaining channels of the multi-channel signal;

a second parameter ($CLD_1$) having energy information for a combination of the LF and RF channel and the center channel (C);

a third parameter ($CLD_2$) having energy information for the LS and the RS channel; and a fourth CLD parameter ($CLD_3$) having energy information for the LF and the RF channel, and wherein the parameter calculator comprises a hardware implementation.

2. Parameter calculator in accordance with claim 1, in which the parameter recalculator is adapted to use multi-channel parameters describing signal properties of a channel or a combination of channels of the multi-channel signal with respect to another channel or another combination of channels of the multi-channel signal.

3. Parameter calculator in accordance with claim 2, in which the parameter recalculator is operative to derive upmix parameters describing the same signal properties of the channels of the stereo representation as the multi-channel parameters.

4. Parameter calculator in accordance with claim 1, in which the parameter recalculator is operative to derive the CLD parameter according to the following formula:

$$CLD = 10\log_{10}\left(\frac{L_0}{R_0}\right),$$

in which $L_0$ and $R_0$ are normalized powers of stereo output channels L and R derived by $$L_0 = L_f + L_s + \frac{C}{2},$$

$$R_0 = R_f + R_s + \frac{C}{2},$$

wherein the powers of the multi-channel signals are derived from the CLD parameters as follows:

$$L_f = (c_{10}c_{11}c_{13})^2,$$

$$R_f = (c_{10}c_{11}c_{23})^2,$$

$$C = (c_{10}c_{21})^2,$$

$$L_s = (c_{20}c_{12})^2,$$

$$R_s = (c_{20}c_{22})^2,$$

$$c_{1X} = \sqrt{\frac{10^{CLD_X/10}}{1+10^{CLD_X/10}}} \text{ and } c_{2X} = \sqrt{\frac{1}{1+10^{CLD_X/10}}}.$$

5. Parameter calculator in accordance with claim 1, in which the parameter recalculator is operative to derive the ICC parameter using:

a first CLD parameter ($CLD_0$) having energy information for a combination of the LF and LR channel and a combination of the remaining channels of the multi-channel signal:

a second parameter ($CLD_1$) having energy information for a combination of the LF and RF channel and the center channel (C):

a third parameter ($CLD_2$) having energy information for the LS and the RS channel; and a fourth CLD parameter ($CLD_3$) having energy information for the LF and the RF channel;

a first ICC parameter ($ICC_2$) having information on a correlation between the LS and the RS channel; and a second ICC parameter ($ICC_3$) having information on a correlation between the LF and the RF channel.

6. Parameter calculator in accordance with claim 5, in which the ICC parameter is derived according to the following formula:

$$ICC = \max\left\{-.99, \min\left\{1, \frac{p}{\sqrt{L_0R_0}}\right\}\right\},$$

in which a correlation estimate p is defined as $$p = \frac{C}{2} + ICC_2c_{20}^2c_{12}c_{22} + ICC_3(c_{10}c_{11})^2c_{13}c_{23},$$

wherein $$c_{1X} = \sqrt{\frac{10^{CLD_X/10}}{1+10^{CLD_X/10}}} \text{ and } c_{2X} = \sqrt{\frac{1}{1+10^{CLD_X/10}}}.$$

7. Parameter calculator in accordance with claim 1, in which the parameter recalculator is operative to derive the CLD parameter using:

a first CLD parameter $CLD_0$ having energy information for the center channel (C) and a combination of the other channels of the multi-channel signal;

a second CLD parameter ($CLD_1$) having energy information for a combination of the LF and LS channel and a combination of the RF and RS channel;

an ICC parameter ($ICC_0$) having correlation information between the center channel (C) and a combination of the other channels of the multi-channel signal.

8. Parameter calculator in accordance with claim 7, in which the CLD parameter is derived from the following formula:

$$CLD = 10\log_{10}\left(\frac{L_0}{R_0}\right),$$

in which $L_0$ and $R_0$ are normalized powers of stereo output channels L and R derived by $$L_0 = L + \frac{C}{2} + \sqrt{2}\,ICC_0\sqrt{LC}$$

$$R_0 = R + \frac{C}{2} + \sqrt{2}\,ICC_0\sqrt{RC},$$

wherein $$L = (c_{10}c_{11})^2,$$

$$R = (c_{10}c_{21})^2,$$

$$C = c_{20}^2,$$

and $$c_{1X} = \sqrt{\frac{10^{CLD_X/10}}{1+10^{CLD_X/10}}} \text{ and } c_{2X} = \sqrt{\frac{1}{1+10^{CLD_X/10}}}.$$

9. Parameter calculator in accordance with claim 1, in which the parameter recalculator is operative to derive the ICC parameter using:

a first CLD parameter $CLD_0$ having energy information for the center channel (C) and a combination of the other channels of the multi-channel signal;

a second CLD parameter ($CLD_1$) having energy information for a combination of the LF and LS channel and a combination of the RF and RS channel;

a first ICC parameter ($ICC_0$) having correlation information between the center channel (C) and a combination of the other channels of the multi-channel signal; and a second ICC parameter ($ICC_1$) having correlation information between a combination of the LF and the LS channel and a combination of the RF and RS channel.

10. Parameter calculator in accordance with claim 9, in which the parameter recalculator is operative to derive the ICC value using the following formula:

$$ICC = \max\left\{-.99, \min\left\{1, \frac{p}{\sqrt{L_0R_0}}\right\}\right\},$$

wherein a correlation measure p is derived as $$p = \frac{C}{2} + c_{10}\left(ICC_1 c_{10} c_{11} c_{21} + \frac{1}{\sqrt{2}} ICC_0 c_{20} \sqrt{1 + ICC_1 c_{11} c_{21}}\right),$$

with $$c_{1X} = \sqrt{\frac{10^{CLD_X/10}}{1 + 10^{CLD_X/10}}} \text{ and } c_{2X} = \sqrt{\frac{1}{1 + 10^{CLD_X/10}}}$$

and $$C = c_{20}^2.$$

11. Parameter calculator in accordance with claim 1, in which the parameter recalculator is operative to use multi-channel parameters describing a subband representation of the multi-channel signal.

12. Parameter calculator in accordance with claim 1, in which the parameter recalculator is operative to use complex valued multi-channel parameters.

13. Parameter calculator in accordance with claim 1, wherein the parameter calculator is configured for upmixing a downmix signal into an intermediate channel representation of a multi-channel signal having more channels than the downmix signal and less channels than the multi-channel signal, the downmix signal having associated thereto multi-channel parameters describing spatial properties of the multi-channel signal, wherein the multi-channel signal includes channels not included in the intermediate channel representation, and wherein the multi-channel parameters include information on the channels not included in the intermediate channel representation.

14. Channel reconstructor comprising:

a parameter reconstructor for deriving upmix parameters for upmixing a downmix signal into a repres entation of a multi-channel signal having more channels than the downmix signal and less channels than the multi-channel signal, the downmix signal having associated thereto multi-channel parameters describing spatial properties of the multi-channel signal, wherein the multi-channel signal includes channels not included in the representation and wherein the multi-channel parameters include information on the channels not included in the stereo representation, the parameter reconstructor comprising:

a parameter calculator for deriving the upmix parameters from the multi-channel parameters using the parameters having information on channels not included in the representation of the multi-channel signal, wherein the parameter calculator is adapted to use correlation parameters (ICC) having information on a correlation and level parameters (CLD) having energy information for a channel or a combination of channels of the multi-channel signal with respect to another channel or another combination of channels of a multi-channel signal, wherein the parameter calculator is configured to use multi-channel parameters for a multi-channel signal comprising a left front (LF), a left surround (LS), a right front (RF), a right surround (RS) and a center channel (C), and the parameter calculator is operative to derive upmix parameters for an intermediate channel representation having two channels, the upmix parameters including one CLD parameter and one ICC parameter, wherein the parameter calculator is operative to derive the CLD parameter having energy information for a left and a right channel of the intermediate channel representation using:

a first CLD parameter ($CLD_0$) having energy information for a combination of the LF and LR channel and a combination of the remaining channels of the multi-channel signal;

a second parameter ($CLD_1$) having energy information for a combination of the LF and RF channel and the center channel (C);

a third parameter ($CLD_2$) having energy information for the LS and the RS channel; and a fourth CLD parameter ($CLD_3$) having energy information for the LF and the RF channel, an upmixer for deriving the stereo representation using the upmix parameters comprising the CLD parameter and the ICC parameter and the mono downmix signal, wherein the channel reconstructor comprises a hardware implementation.

15. Method for generating upmix parameters, comprising:

deriving the upmix parameters from multi-channel parameters using parameters having information on channels not included in an intermediate channel representation, wherein correlation parameters (ICC) having information on a correlation and level parameters (CLD) having energy information for a channel or a combination of channels of the multi-channel signal with respect to another channel or another combination of channels of a multi-channel signal are used, wherein multi-channel parameters for a multi-channel signal comprising a left front (LF), a left surround (LS), a right front (RF), a right surround (RS) and a center channel (C), are used, and upmix parameters for an intermediate channel representation having two channels are derived, the upmix parameters including one CLD parameter and one ICC parameter, wherein the CLD parameter having energy information for a left and a right channel of the intermediate channel representation are derived using:

a first CLD parameter ($CLD_0$) having energy information for a combination of the LF and LR channel and a combination of the remaining channels of the multi-channel signal;

a second parameter ($CLD_1$) having energy information for a combination of the LF and RF channel and the center channel (C);

a third parameter ($CLD_2$) having energy information for the LS and the RS channel; and a fourth CLD parameter ($CLD_3$) having energy information for the LF and the RF channel, wherein the method is performed by a hardware apparatus.

16. Audio receiver or audio player, the receiver or audio player comprising:

a parameter calculator for deriving upmix parameters for upmixing a downmix signal into an intermediate channel representation of a multi-channel signal having more channels than the downmix signal and less channels than the multi-channel signal, the downmix signal having associated thereto multi-channel parameters describing spatial properties of the multi-channel signal, wherein the multi-channel signal includes channels not included in the intermediate channel representation and wherein the multi-channel parameters include information on the channels not included in the intermediate channel representation, the parameter calculator comprising:

a parameter recalculator for deriving the upmix parameters from the multi-channel parameters using the parameters having information on channels not included in the intermediate channel representation, wherein the parameter recalculator is adapted to use correlation parameters (ICC) having information on a correlation and level parameters (CLD) having energy information for a channel or a combination of channels of the multi-channel signal with respect to another channel or another combination of channels of a multi-channel signal, wherein the parameter calculator is configured to use multi-channel parameters for a multi-channel signal comprising a left front (LF), a left surround (LS), a right front (RF), a right surround (RS) and a center channel (C), in which the parameter calculator is operative to derive upmix parameters for an intermediate channel representation having two channels, the upmix parameters including one CLD parameter and one ICC parameter, wherein the parameter calculator is operative to derive the CLD parameter having energy information for a left and a right channel of the intermediate channel representation using:

a first CLD parameter ($CLD_0$)having energy information for a combination of the LF and LR channel and a combination of the remaining channels of the multi-channel signal;

a second parameter ($CLD_1$) having energy information for a combination of the LF and RF channel and the center channel (C);

a third parameter ($CLD_2$) having energy information for the LS and the RS channel; and a fourth CLD parameter ($CLD_3$) having energy information for the LF and the RF channel.

17. Method of receiving or audio playing, comprising:

a method for generating upmix parameters for upmixing a downmix signal into an intermediate channel representation of a multi-channel signal having more channels than the downmix signal and less channels than the multi-channel signal, the downmix signal having associated thereto multi-channel parameters describing spatial properties of the multi-channel signal, wherein the multi-channel signal includes channels not included in the intermediate channel representation, the method comprising:

deriving the upmix parameters from the multi-channel parameters using the parameters having information on channels not included in the intermediate channel representation wherein correlation parameters (ICC) having information on a correlation and level parameters (CLD) having energy information for a channel or a combination of channels of the multi-channel signal with respect to another channel or another combination of channels of a multi-channel signal are used, wherein multi-channel parameters for a multi-channel signal comprising a left front (LF), a left surround (LS), a right front (RF), a right surround (RS) and a center channel (C), are used, and upmix parameters for an intermediate channel representation having two channels are derived, the upmix parameters including one CLD parameter and one ICC parameter, wherein the CLD parameter having energy information for a left and a right channel of the intermediate channel representation are derived using:

a first CLD parameter ($CLD_0$) having energy information for a combination of the LF and LR channel and a combination of the remaining channels of the multi-channel signal;

a second parameter ($CLD_1$) having energy information for a combination of the LF and RF channel and the center channel (C);

a third parameter ($CLD_2$) having energy information for the LS and the RS channel; and a fourth CLD parameter ($CLD_3$) having energy information for the LF and the RF channel, wherein the method is performed by a hardware apparatus.

18. Non-transitory storage medium having stored thereon a computer program, comprising:

a program code for performing, when running on a computer, a method for generating upmix parameters for upmixing a downmix signal into an intermediate channel representation of a multi-channel signal having more channels than the downmix signal and less channels than the multi-channel signal, the downmix signal having associated thereto multi-channel parameters describing spatial properties of the multi-channel signal, wherein the multi-channel signal includes channels not included in the intermediate channel representation and wherein the multi-channel parameters include information on the channels not included in the intermediate channel representation, the method comprising:

deriving the upmix parameters from the multi-channel parameters using the parameters having information on channels not included in the intermediate channel representation wherein correlation parameters (ICC) having information on a correlation and level parameters (CLD) having energy information for a channel or a combination of channels of the multi-channel signal with respect to another channel or another combination of channels of a multi-channel signal are used, wherein multi-channel parameters for a multi-channel signal comprising a left front (LF), a left surround (LS), a right front (RF), a right surround (RS) and a center channel (C), are used, and upmix parameters for an intermediate channel representation having two channels are derived, the upmix parameters including one CLD parameter and one ICC parameter, wherein the CLD parameter having energy information for a left and a right channel of the intermediate channel representation are derived using:

a first CLD parameter ($CLD_0$) having energy information for a combination of the LF and LR channel and a combination of the remaining channels of the multi-channel signal;

a second parameter ($CLD_1$) having energy information for a combination of the LF and RF channel and the center channel (C);

a third parameter ($CLD_2$) having energy information for the LS and the RS channel; and a fourth CLD parameter ($CLD_3$) having energy information for the LF and the RF channel.

19. Non-transitory storage medium having stored thereon a computer program comprising:

a program code for performing, when running on a computer, a method for receiving or audio playing, the method having a method for generating upmix parameters for upmixing a downmix signal into an intermediate channel representation of a multi-channel signal having more channels than the downmix signal and less channels than the multi-channel signal, the downmix signal having associated thereto multi-channel parameters describing spatial properties of the multi-channel signal, wherein the multi-channel signal includes channels not included in the intermediate channel representation and wherein the multi-channel parameters include information on the channels not included in the intermediate channel representation, the method comprising:

deriving the upmix parameters from the multi-channel parameters using the parameters having information on channels not included in the intermediate channel representation, wherein correlation parameters (ICC) having information on a correlation and level parameters (CLD) having energy information for a channel or a combination of channels of the multi-channel signal with respect to another channel or another combination of channels of a multi-channel signal are used, wherein multi-channel parameters for a multi-channel signal comprising a left front (LF), a left surround (LS), a right front (RF), a right surround (RS) and a center channel (C), are used, and upmix parameters for an intermediate channel representation having two channels are derived, the upmix parameters including one CLD parameter and one ICC parameter, wherein the CLD parameter having energy information for a left and a right channel of the intermediate channel representation are derived using:

a first CLD parameter ($CLD_0$) having energy information for a combination of the LF and LR channel and a combination of the remaining channels of the multi-channel signal;

a second parameter ($CLD_1$) having energy information for a combination of the LF and RF channel and the center channel (C);

a third parameter ($CLD_2$) having energy information for the LS and the RS channel; and a fourth CLD parameter ($CLD_3$) having energy information for the LF and the RF channel.

20. Method in accordance with claim 15, wherein the method is for upmixing a downmix signal into an intermediate channel representation of a multi-channel signal having more channels than the downmix signal and less channels than the multi-channel signal, the downmix signal having associated thereto multi-channel parameters describing spatial properties of the multi-channel signal, wherein the multi-channel signal includes channels not included in the intermediate channel representation and wherein the multi-channel parameters include information on the channels not included in the intermediate channel representation.

* * * * *